US005547181A

United States Patent [19]

Underwood

[11] Patent Number: 5,547,181

[45] Date of Patent: Aug. 20, 1996

[54] MEDIA SHEET PICK AND FEED SYSTEM

[75] Inventor: John A. Underwood, Vancouver, Wash.

[73] Assignee: Hewlett-Packard Company, Palo Alto, Calif.

[21] Appl. No.: 579,727

[22] Filed: Dec. 20, 1995

Related U.S. Application Data

[63] Continuation of Ser. No. 238,601, Aug. 3, 1994, abandoned.

[51] Int. Cl.[6] ..... B65H 3/06

[52] U.S. Cl. ..... 271/114; 271/116; 271/117

[58] Field of Search ..... 271/114, 116, 271/117, 242, 10.09, 10.11, 10.13

[56] References Cited

U.S. PATENT DOCUMENTS

| | | | |
|---|---|---|---|
| 4,290,593 | 9/1981 | Irvine | 271/42 |
| 4,337,935 | 7/1982 | Sawada et al. | 271/242 X |
| 4,925,062 | 5/1990 | Tsukamoto et al. | 271/114 X |
| 4,934,686 | 6/1990 | Ono et al. | 271/117 |
| 5,085,420 | 2/1992 | Sata | 271/114 |

FOREIGN PATENT DOCUMENTS

| | | | |
|---|---|---|---|
| 2851458A1 | 11/1978 | Germany . | |
| 3177239 | 8/1991 | Japan | 271/114 |

*Primary Examiner*—David H. Bollinger

[57] ABSTRACT

A media sheet pick and feed system includes a pick roller shaft that is mounted for rotation and a media sheet tray which supports a stack of media sheets on a support surface. The support surface is separated from the pick roller shaft by a fixed distance during pick operations. An arm structure is coupled to and extends from the pick roller shaft and includes a pick roller that is geared to the pick roller shaft. A drive motor having first and second directions of rotation is couplable via a clutch to the pick roller shaft. During a driven state, the drive motor, through the clutch, causes the pick roller shaft to rotate and operate the pick roller. The clutch mechanism in the non-driven state is uncoupled from the pick roller shaft and enables the pick roller to free wheel while it still remains in contact with a media sheet being fed. The pick roller is never out of contact with media sheets supported by the media sheet tray.

8 Claims, 3 Drawing Sheets

MEDIA SHEET PICK AND FEED SYSTEM

This is a continuation of application Ser. No. 08/238,601 filed on May 3, 1994, now abandoned.

FIELD OF THE INVENTION

This invention relates to media sheet feeders, and more particularly, to a media sheet pick and feed system that obviates the need for a spring loaded media sheet tray and enables easy re-loading of a media sheet tray.

BACKGROUND OF THE INVENTION

A commonly used prior art mechanism for picking and feeding of media sheets employs a D-shaped wheel which is rotated to cause a media sheet pick action. During a sheet feed subsequent to a pick action, the flat section of the D-wheel remains out-of-contact with the fed sheet. This arrangement is satisfactory so long as the media sheet, during a feed operation, is not bent around the D-wheel shaft. This may occur when the media tray is positioned at an angle to the feed mechanism. Under such a circumstance, the media sheet must bend as it is fed into the print mechanism. If the media sheet presses against the D-shaped wheel, significant drag on the media sheet results. A solution to this problem has been to affix a pair of free-wheeling disks to the same shaft on which the D-wheel is mounted. These disks protrude beyond the flat section of the D-wheel (or wheels) thereby enabling the media sheet to be pressed against the disks instead of the D-wheel during the feed operation. A further solution to this problem is the use of an additional shaft after the D-wheel shaft so that the media sheet bends around circular rollers on the additional shaft. Both solutions add to the part count and cost of the media sheet pick and feed system.

Another prior art pick and feed system is shown in FIGS. 1–3 which illustrate a pick roller system employed in a media sheet feed mechanism manufactured by the Epson Corporation. FIG. 1 is a side view of the Epson pick wheel and comprises a drive gear 10 that is mounted on a shaft 12 which is, in turn, coupled to a drive motor (not shown). A pivot arm 14 is mounted for rotation about shaft 12 and encloses a rubber pick roller 16. A driven gear 18 mates with drive gear 10, is rigidly connected to rubber pick roller 16, and is mounted for rotation on a shaft 20. A spring washer 22 is positioned between an inner surface of arm 14 and driven gear 18 and performs a friction clutch function.

A media tray includes a pressure plate 24 which supports a stack of media sheets 26 and is biased by a spring 28 into contact with rubber pick roller 16. An edge separator 30 is positioned to maintain an uppermost sheet on stack 26 in place until operation of rubber pick roller 16.

Referring to FIGS. 2 and 3, schematic views are shown of the pick roller and feed system of FIG. 1. To implement a pick operation, drive gear 10 is driven in a counter clockwise (CCW) direction thereby causing driven gear 18 to rotate in a clockwise (CW) direction. Due to the friction exerted by spring washer 22, arm 14 and pick roller 16 are caused to rotate in a CCW direction until arm 14 hits a stop 32. This action causes pick roller 16 to come into contact with an uppermost sheet of stack 26, which uppermost sheet is, in turn, forced against pick roller 16 through the action of spring 28 on tray 24. Continued clockwise rotation of pick roller 16 causes a feed of an uppermost sheet 34 from stack 26.

As shown in FIG. 3, when uppermost media sheet 34 is grabbed by a pair of feed rollers 36, the direction of rotation of driven gear 10 is reversed to a CW direction, thereby causing arm 14 and pick roller 16 to rotate in a CCW direction and out of engagement with uppermost sheet 34. The CCW rotation of pick roller 16 is required as the clutching action of spring washer 22 would cause pick roller 16 to impede the feeding of media sheet 34, were it not brought out of engagement. The CCW rotation of arm 14 and pick roller 16 continues until arm 14 hits a second stop 38.

The use of a spring loaded tray may require that the media sheet tray be removed for media sheet reloading or that a camming mechanism be provided that depresses the pressure plate to enable reloading. The camming mechanism increases torque requirements on the mechanism drive motor.

Accordingly, it is an object of this invention to provide a media sheet pick and feed system which exhibits decreased torque drive requirements and can be easily reloaded with media sheets.

It is another object of this invention to provide an improved media sheet pick and feed system wherein the position of the pick roller automatically adjusts to height variations of a stack of media sheets.

It is yet another object of this invention to provide an improved media sheet pick and feed system which employs a fixed position media sheet tray and requires no spring loading of media sheets against a pick roller.

It is yet another object of this invention to provide an improved media sheet pick and feed system that is capable of a handling a wide range of paper weights.

SUMMARY OF THE INVENTION

A media sheet pick and feed system includes a pick roller shaft that is mounted for rotation and a media sheet tray which supports a stack of media sheets on a support surface. The support surface is separated from the pick roller shaft by a fixed distance during pick operations. An arm structure is coupled to and extends from the pick roller shaft and includes a pick roller that is geared to the pick roller shaft. A drive motor having first and second directions of rotation is coupleable via a clutch to the pick roller shaft. During a driven state, the drive motor, through the clutch, causes the pick roller shaft to rotate and operate the pick roller. The clutch mechanism in the non-driven state is uncoupled from the pick roller shaft and enables the pick roller to free wheel while it still remains in contact with a media sheet being fed. The pick roller is never out of contact with media sheets supported by the media sheet tray.

DESCRIPTION OF THE DRAWINGS

FIG. 9 is a schematic view of an idler roller of the mechanism of FIG. 4.

DETAILED DESCRIPTION OF THE INVENTION

Figure 4:
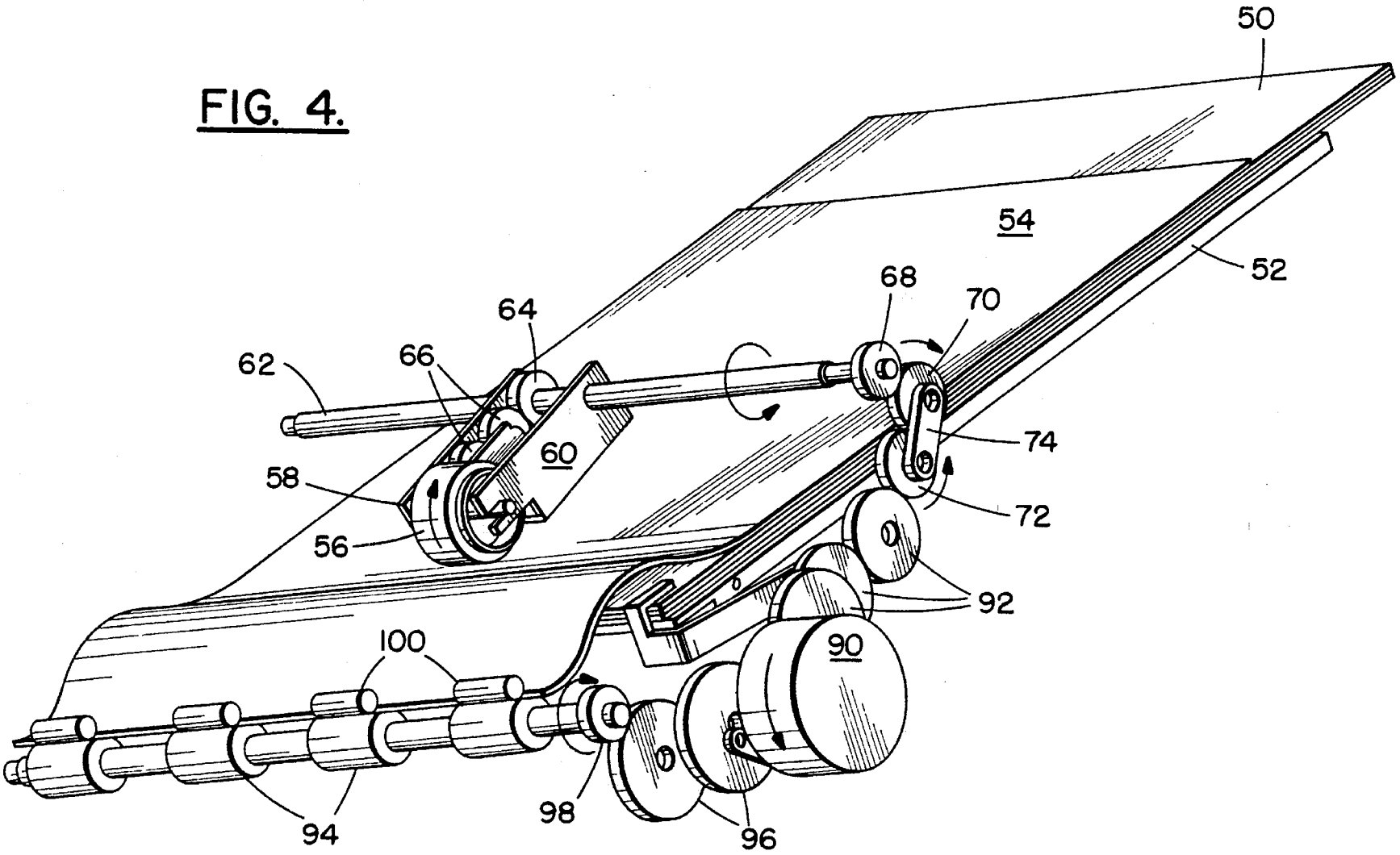
FIG. 4 is a perspective view of a media sheet pick and feed system incorporating the invention hereof and illustrating a pick action.

Referring to FIG. 4, a stack of media sheets 50 is supported on a tray 52 which is slidably removable from and insertable into a print mechanism. Tray 52 may be replenished with media sheets without removal from the print mechanism. Tray 52, when in position within the print mechanism, rests in a stationary position and includes no spring means for biasing stack 50 against the picking and feeding apparatus.

A pair of arms 58 and 60 extend from and are mounted for rotation about a pick roller shaft 62. Arms 58 and 60 are connected (not shown) so as to always move in tandem. A pick roller drive gear 64 is rigidly mounted to pick roller shaft 62 and, through a pair of idler rollers 66, engages a gear (not shown) that is rigidly coupled to pick roller 56. Arms 58 and 60 enable pick roller 56 to rest on the topmost media sheet 54 of stack 50. The outer surface of pick roller 56 is preferably comprised of a rubber or a rubber-like material. As the size of stack 50 either increases or decreases, arms 58 and 60 rotate about pick roller shaft 62 and maintain pick roller 56 in constant contact with an uppermost sheet 54.

Figure 1:
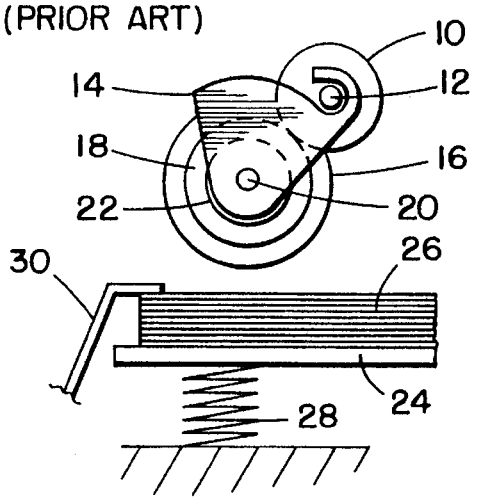
FIG. 1. (PRIOR ART)
FIG. 1 is a side view of a prior art pick roller mechanism.
Figure 2:
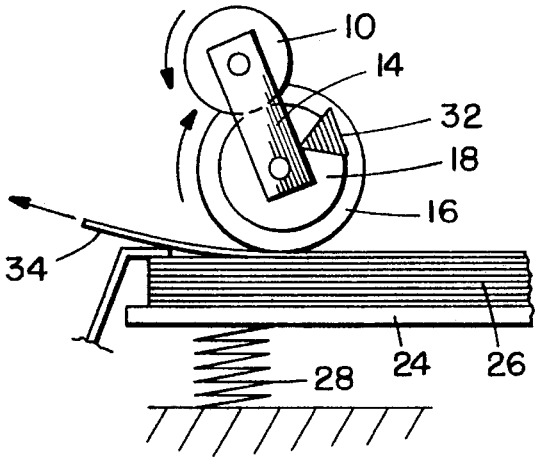
FIG. 2. (PRIOR ART)
FIG. 2 is a schematic side view of the pick roller mechanism of FIG. 1 during a pick action.
Figure 3:
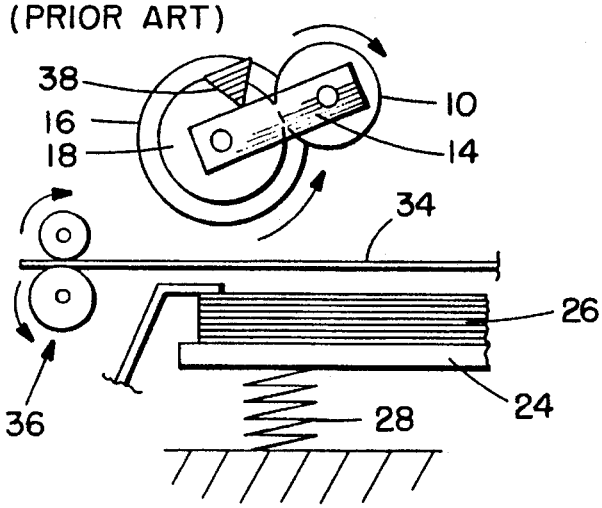
FIG. 3. (PRIOR ART)
FIG. 3 is a schematic side view of the pick roller mechanism of FIG. 1 after the pick action and during a sheet feed.
Figure 5:
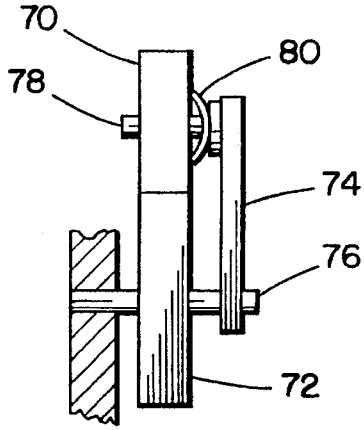
FIG. 5 is a front view of a clutch mechanism employed to drive a pick roller shaft in the system of FIG. 4.
Figure 6:
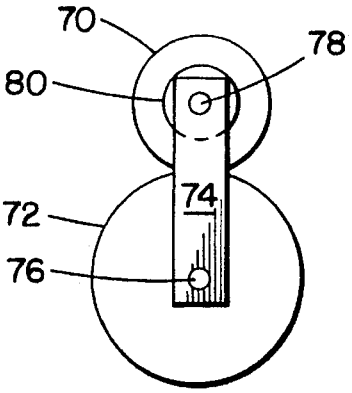
FIG. 6 is a side view of the clutch mechanism shown in FIG. 5.

At one extremity of pick roller shaft 62 is a drive gear 68 that engages a friction clutch mechanism comprising gears 70, 72 and arm 74. A side view of the clutch mechanism (as seen from below tray 52) is shown in FIG. 5 and a plan view in FIG. 6. Gear 72 is mounted on a shaft 76 that extends from a fixed wall position (not shown) in FIG. 4. Gear 70 is connected to arm 74 via a shaft 78. A spring 80 is positioned between gear 70 and arm 74 so as to provide a frictional clutching operation. When gear 72 is rotated CCW, gear 70 rotates in a CW direction and due to the action of spring 80, arm 74 rotates in a CCW direction. This action brings gear 70 into engagement with gear 68 on pick roller shaft 62. By contrast, CW rotation of gear 72 causes arm 74 to rotate in a CW direction, bringing gear 70 out of engagement with gear 68. A stop (not shown) engages arm 74 so as to limit its CW travel.

Returning to FIG. 4, a motor 90, when driven CCW, operates through idler gears 92 to drive gear 72 in a CCW direction. Gear 70 is thus caused to rotate in a CW direction, causing gear 68 and pick rotor shaft 62 to rotate in a CCW direction. That rotary motion is transferred via gear 64 and idler gears 66 and causes pick roller 56 to rotate in the CW direction. Because arms 58 and 60 are rotatably mounted on pick roller shaft 62, pick roller 56 rests on uppermost sheet 54 of stack 50.

During the pick action, the CW rotation of pick roller 56 causes media sheet 54 to move in a leftward direction towards feed rollers 94. The CCW movement of motor 90 is transmitted to feed rollers 94 through idler gears 96 and feed roller drive gear 98. Feed roller drive gear 98 and feed rollers 94 rotate in a CW direction. The CW rotation of feed rollers 94 prevents the passage of media sheet 54 therethrough. As a result, media sheet 54 is pushed against the nip between feed rollers 94 and pinch rollers 100, thus causing a transverse alignment action to be imparted to media sheet 54.

Figure 7:
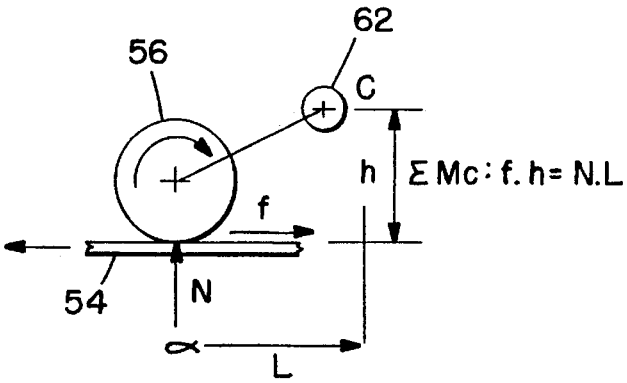
FIG. 7 is a force diagram illustrating a force feedback action which occurs during the operation of the pick roller shown in FIG. 4.

A feature of the invention is that the arrangement of pick roller 56 in relation to topmost media sheet 54 enables a force feedback action which causes the normal force between pick roller 56 and media sheet 54 to increase so long as media sheet 54 resists travel in the feed direction. This feature can be understood by referring to FIG. 7 wherein pick roller 56 is shown engaging an uppermost surface of media sheet 54.

As the CW motion of pick roller 56 acts upon media sheet 54, media sheet 54 exerts a counter force f which resists the pick action. This force f is equal and acts in the opposite direction to the driving force $f_d$ exerted by pick roller 56 on media sheet 54 (i.e. $f_d=-f$). The maximum value that $f_d$ can attain is $f_{dmax}=u\cdot N$, where u is the coefficient of friction between pick roller 56 and media sheet 54 and N is the normal force acting between pick roller 56 and media sheet 54. When the CW motion of the pick roller begins, $f_d$ increases from 0 to some value less than or equal to $f_{dmax}$ ($=u\cdot N$). Initially, N is small and fd is too small to overcome the resistance of media sheet 54. However, N increases as $f_d$ increases. This can be explained as follows. Force f ($f=-f_d$) applies a moment $(f\cdot h)$ about pickroller shaft 62. Ignoring the masses of the parts (for simplicity), for static balance, the moment $(f\cdot h)$ must be balanced by an opposing moment and the only force that can apply the opposing moment is normal force N (i.e. $N\cdot L$). Therefore, as f increases, normal force N must also increase to preserve the static balance. An increase in N results in an increase in the maximum driving force available $f_{dmax}$. This allows $f_d$ to continue to increase until a point is reached where it is large enough to overcome the resistance of media sheet 54.

The more sheet 54 resists the pick action, the more driving force is thus available to the pick action. This arrangement of forces differs from the prior art designs that use a spring-loaded pressure plate. In such designs, the normal force is provided by the springs under the pressure plate and the normal force is fixed. So also is the maximum driving friction force available.

The force feedback effect varies as the height of pick roller 110 56 changes with changes in the size of stack 50. This is because moment arm h changes with height of stack 50. Nevertheless, so long as $h>0$ and pick roller 110 56 contacts media sheet 54 downstream in the feed direction from pick roller shaft 62, the normal force feedback action occurs.

Figures 8, 9:
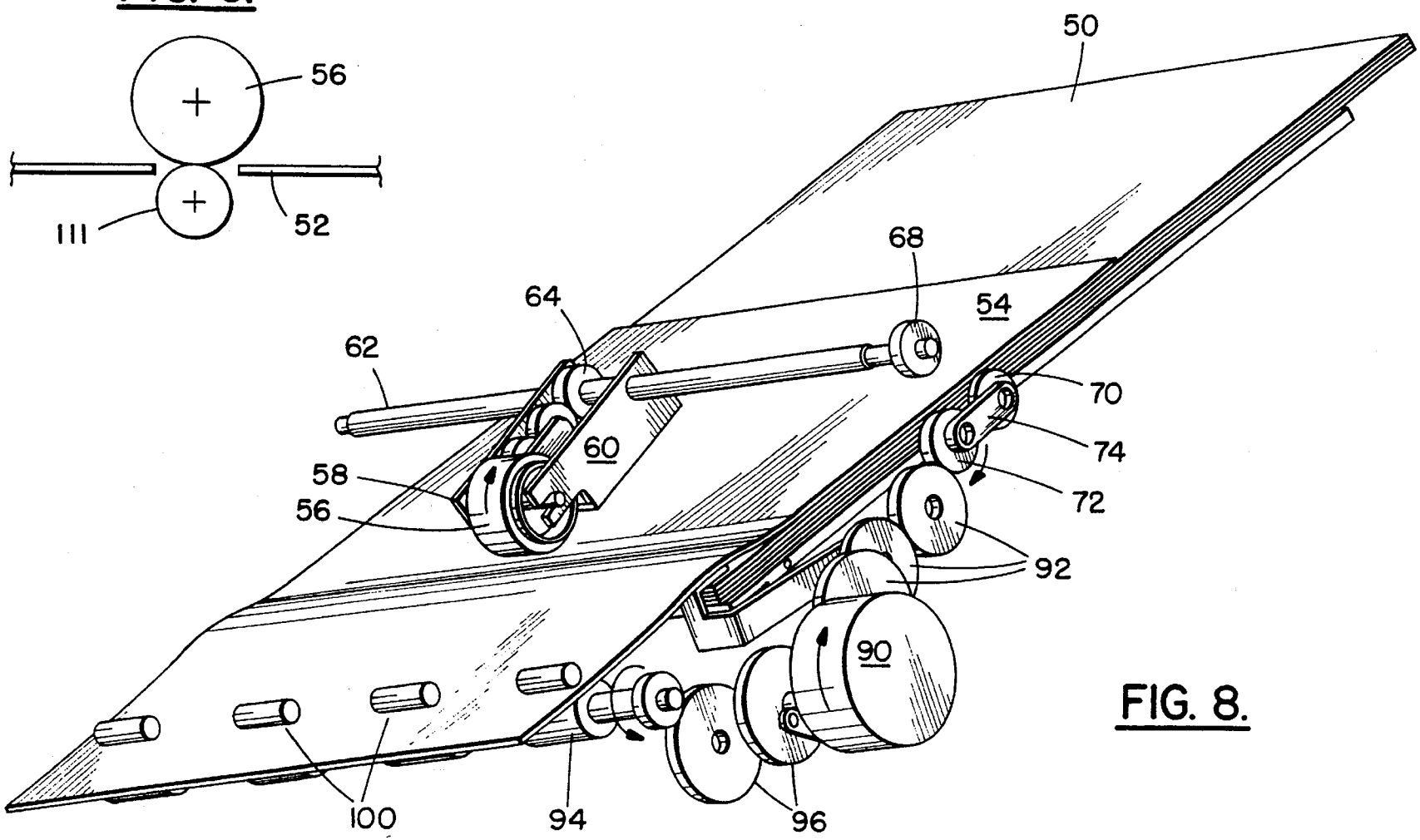
FIG. 8 is a perspective view of the mechanism of FIG. 4 after a pick action has been accomplished and when a media sheet is being fed by feed rollers.
FIG. 9 is a schematic view of an idler roller 111 positioned in the bottom of tray 52 for preventing pick roller 56 from contacting tray 52 when no media sheet is present thereon.

In the event of an empty media tray 52, pick roller 56 will contact tray 52. If a pick action is initiated, large forces can be generated between pick roller 56 and tray 52 which can cause motor 90 to stall or may cause parts in the pick mechanism to break. This situation must be avoided. Various approaches can be taken to avoid it. For example, an optical sensor (e.g., see 110 in FIG. 8) may be used to sense paper in the tray in order to prevent an attempt to pick from an empty tray. Another approach, shown in FIG. 9, is to place an idler roller 111 in the bottom of tray 52, underneath pick roller 56. The idler roller 111 will then rotate with pick roller 56 during any attempt to pick from an empty tray 52, thereby limiting the forces generated by pick roller 56 to the level required to turn the idler roller 111. With the idler roller positioned in the bottom of tray 52, the pick roller 56 is prevented from contacting tray 52 when no media sheet is present thereon.

Turning to FIG. 8, a feed operation will be described. Once media sheet 54 reaches the configuration shown in FIG. 4, the direction of rotation of motor 90 is changed to a CW direction. The CW rotation is transmitted via idler gears 92 and causes a CW rotation of gear 72. As a result of the clutching action imparted by gear 70, arm 74 rotates in a CW direction out of engagement with gear 68. Arm 74 is limited in its clockwise rotation by a stop (not shown).

The disengagement of gear 70 from gear 68 allows pick roller shaft 62 to operate in a free-wheeling mode so that pick roller 56 is free to continue rotation in a CW direction while feed rollers 94 are rotated in a CCW direction by the drive action transmitted through idler gears 96 from motor 90. Because of the free wheeling action of pick roller 56, there is little resistance to travel of topmost media sheet 54 during the operation of feed rollers 94. As the height of stack 50 varies (both upwardly and downwardly) pick roller 56 is in contact with the uppermost sheet due to the rotation of arms 58 and 60 about pick roller shaft 62.

As a result of the above described design, the initial normal force exerted by pick roller 56 on an uppermost media sheet can be quite low, because the needed additional force during picking is generated if the sheet resists picking. This helps during the loading of additional sheets as pick roller 56 can be easily lifted by a stack of inserted papers. The low normal force also helps to reduce drag when the topmost sheet is being advanced by feed rollers 94. The system also enables the handling of a large range of paper weights due to its ability to generate an amount of normal force required in each case.

It should be understood that the foregoing description is only illustrative of the invention. Various alternatives and modifications can be devised by those skilled in the art without departing from the invention. For instance, if it is desired to mount the media tray of FIGS. 4 and 8 in a vertical or near vertical orientation, a spring bias would be required to bias pick roller 56 against stack 54. Accordingly, the present invention is intended to embrace all such alternatives, modifications and variances which fall within the scope of the appended claims.

I claim:

1. A media sheet pick and feed system comprising:

a pick roller shaft mounted for rotation;

a media sheet support surface for supporting a stack of media sheets during pick and feed operations, said support surface separated from said pick roller shaft by a fixed distance during said operations;

arm means coupled to and extending from said pick roller shaft;

pick roller means rotatably supported by said arm means so as to rest upon an upper most media sheet of said stack, and drivingly engaged with said pick roller shaft;

drive means juxtaposed to, and for rotating said pick roller shaft and having first and second directions of rotation; and clutch means positioned between said drive means and said pick roller shaft, having a driving state and a non-driving state and in said driving state, coupling said drive means to said pick roller shaft to cause a rotation thereof and a pick rotation of said pick roller means said clutch means in said non-driving state being uncoupled from said pick roller shaft to enable free wheeling of said pick roller shaft and pick roller means while still in contact with a media sheet being fed.

2. The media sheet pick and feed system as recited in claim 1, further comprising:

feed roll means positioned in a feed direction from said pick roller means and coupled to said drive means while said drive means is rotating in said first direction of rotation, said feed roll means thereby caused by said drive means to rotate to impede a media sheet from moving in a feed direction while said pick roller means is rotating in a pick direction, said feed roll means and pick roller means cooperating to thereby enable an alignment of said media sheet against said feed roll means.

3. The media sheet pick and feed system as recited in claim 2 wherein said feed roll means responds to a rotation of said drive means in said second direction of rotation to feed a media sheet in engagement therewith.

4. The media sheet pick and feed system as recited in claim 1, wherein said arm means extends from said pick roller shaft in a direction in which said media sheets are to be fed and enables said pick roller means to continuously contact a media sheet at a point downstream from said pick roller shaft in a feed direction of said media sheets.

5. The media sheet pick and feed system as recited in claim 3, wherein said arm means includes: a pair of arms rotatably coupled to said pick roller shaft; and said pick roller means includes a pick roller mounted on an axle between said pair of arms at an extremity thereof that is most distant from said pick roller shaft, and gear means drivingly coupling said pick roller to said pick roller shaft.

6. The media sheet pick and feed system as recited in claim 5 wherein said clutch means comprises:

a first gear coupled to said drive means and mounted at one extremity of an arm by a fixed axle;

a second gear, including frictional means, mounted on a translatable axle mounted at a second extremity of said arm, rotation of said first gear by rotation of said drive means in said first direction enabling said frictional means to cause movement of said arm and second gear into driving engagement with drive means on said pick roller shaft, rotation of said first gear in an opposite direction by said drive means enabling said frictional means to cause movement of said arm and second gear out of engagement with said pick roller shaft.

7. The media sheet pick and feed system as recited in claim 4 wherein a stack of media sheets are insertable and removable from said media sheet support surface while engaged with said media sheet pick and feed system, insertion of said stack of media sheets and causing a rotation of said arm means and pick roller means about said pick roller shaft.

8. The media pick and feed system as recited in claim 5 further comprising:

means for preventing said pick roller means from contacting said media sheet support surface during a rotational driven state.

* * * * *